US010968504B2

(12) United States Patent
Kivisakk et al.

(10) Patent No.: US 10,968,504 B2
(45) Date of Patent: Apr. 6, 2021

(54) AUSTENITIC STAINLESS ALLOY

(71) Applicant: SANDVIK INTELLECTUAL PROPERTY AB, Sandviken (SE)

(72) Inventors: Ulf Kivisakk, Sandviken (SE); Karin Antonsson, Sandviken (SE); Peter Stenvall, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 138 days.

(21) Appl. No.: 15/769,144

(22) PCT Filed: Oct. 19, 2016

(86) PCT No.: PCT/EP2016/075117

§ 371 (c)(1),
(2) Date: Apr. 18, 2018

(87) PCT Pub. No.: WO2017/067999

PCT Pub. Date: Apr. 27, 2017

(65) Prior Publication Data

US 2018/0312948 A1 Nov. 1, 2018

(30) Foreign Application Priority Data

Oct. 19, 2015 (EP) ..... 15190386

(51) Int. Cl.

| | |
|---|---|
| ***C22C 38/58*** | (2006.01) |
| ***C22C 38/44*** | (2006.01) |
| ***C22C 38/42*** | (2006.01) |
| ***C22C 38/04*** | (2006.01) |
| ***C22C 38/02*** | (2006.01) |
| ***C22C 38/00*** | (2006.01) |
| ***C21D 6/00*** | (2006.01) |
| ***C21D 7/13*** | (2006.01) |
| ***C22C 1/02*** | (2006.01) |
| *C21D 8/04* | (2006.01) |
| *C22C 38/46* | (2006.01) |
| *C22C 38/52* | (2006.01) |
| *C22C 38/06* | (2006.01) |
| *C22C 38/60* | (2006.01) |
| *C22C 38/54* | (2006.01) |
| *C22C 38/48* | (2006.01) |
| *C22C 38/50* | (2006.01) |

(52) U.S. Cl.

CPC ..... *C22C 38/58* (2013.01); *C21D 6/004* (2013.01); *C21D 7/13* (2013.01); *C22C 1/02* (2013.01); *C22C 38/001* (2013.01); *C22C 38/002* (2013.01); *C22C 38/02* (2013.01); *C22C 38/04* (2013.01); *C22C 38/42* (2013.01); *C22C 38/44* (2013.01); *C21D 8/04* (2013.01); *C21D 2211/001* (2013.01); *C22C 38/005* (2013.01); *C22C 38/06* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01)

(58) Field of Classification Search

CPC .... C21D 2211/001; C21D 6/004; C21D 7/13; C21D 8/04; C22C 1/02; C22C 38/001; C22C 38/002; C22C 38/005; C22C 38/02; C22C 38/04; C22C 38/06; C22C 38/42; C22C 38/44; C22C 38/46; C22C 38/48; C22C 38/50; C22C 38/52; C22C 38/54; C22C 38/58; C22C 38/60

See application file for complete search history.

(56) References Cited

U.S. PATENT DOCUMENTS

| | | | | |
|---|---|---|---|---|
| 4,400,211 | A * | 8/1983 | Kudo | C22C 19/053 420/443 |
| 5,480,609 | A * | 1/1996 | Dupoiron | C22C 38/58 420/45 |
| 5,858,129 | A | 1/1999 | Kobayashi et al. | |
| 6,905,652 | B2 * | 6/2005 | Ulfvin | C22C 38/004 420/586.1 |
| 2003/0143105 | A1 * | 7/2003 | Bahar | C22C 38/005 420/586.1 |
| 2014/0083576 | A1 * | 3/2014 | Sawawatari | C21D 7/10 148/707 |

FOREIGN PATENT DOCUMENTS

| | | | |
|---|---|---|---|
| GB | 2104100 | A | 3/1983 |
| GB | 2154611 | A | 9/1985 |
| JP | H09217150 | A | 8/1997 |
| WO | 03044239 | A1 | 5/2003 |

* cited by examiner

*Primary Examiner* — Jenny R Wu

(74) *Attorney, Agent, or Firm* — Morgan, Lewis & Bockius LLP

(57) ABSTRACT

The present disclosure relates to an austenitic stainless alloy including in weight % (wt %):

C less than 0.03;
Si less than 1.0;
Mn less than or equal to 1.2;
Cr 26.0 to 30.0;
Ni 29.0 to 37.0;
Mo 6.1 to 7.1 or (Mo+W/2) 6.1 to 7.1;
N 0.25 to 0.36;
P less than or equal to 0.04
S less than or equal to 0.03;
Cu less than or equal to 0.4; and a balance of Fe and unavoidable impurities. The austenitic stainless alloy has a low content of manganese in combination with a high content of nitrogen. The present disclosure also relates to the use of the austenitic stainless alloy, especially in highly corrosive environments and to products made of thereof.

18 Claims, 2 Drawing Sheets

AUSTENITIC STAINLESS ALLOY

RELATED APPLICATION DATA

This application is a § 371 National Stage Application of PCT International Application No. PCT/EP2016/075117 filed Oct. 19, 2016 claiming priority to EP 15190386.1 filed Oct. 19, 2015.

TECHNICAL FIELD

The present disclosure relates to a new austenitic stainless alloy comprising a low content of manganese in combination with a high content of nitrogen. The present disclosure also relates to the use of said austenitic stainless alloy, especially in highly corrosive environments and to products made of thereof.

BACKGROUND

In highly corrosive applications, nickel-base alloys are normally used for manufacturing objects instead of conventional stainless alloy because nickel-base alloys have higher corrosion resistance compared to conventional stainless alloy. Additionally, conventional stainless alloys will not possess the required corrosion resistance and the required structure stability.

However, there are drawbacks with using nickel-base alloys because they are expensive and also difficult to manufacture. Thus, there is a need for an alloy having a high corrosion resistance and good structure stability and which is also inexpensive and easy to manufacture.

SUMMARY

One aspect of the present disclosure is to solve or at least to reduce the above-mentioned drawbacks. The present disclosure therefore provides an austenitic stainless alloy having the following composition weight % (wt %):

C less than 0.03;
Si less than 1.0;
Mn less than or equal to 1.2;
Cr 26.0 to 30.0;
Ni 29.0 to 37.0;
Mo or (Mo+W/2) 6.1 to 7.1;
N 0.25 to 0.36;
P less than or equal to 0.04
S less than or equal to 0.03;
Cu less than or equal to 0.4;
balance Fe and unavoidable impurities.

This austenitic stainless alloy as defined hereinabove or hereinafter has a high corrosion resistance and good structure stability. Furthermore, said austenitic stainless alloy has a mechanical strength similar to conventional Ni-base alloys and also good tensile strength and good ductility. Additionally, the present inventors have unexpectedly found an element composition wherein the obtained austenitic stainless alloy has a combination of high ductility and mechanical strength (see FIGS. 1A and 1B), this is very surprising because usually when the mechanical strength is increased, the ductility will be decreased. In the present austenitic alloy, surprisingly both the ductility and yield strength will be increased.

DETAILED DESCRIPTION

Figure 1A:
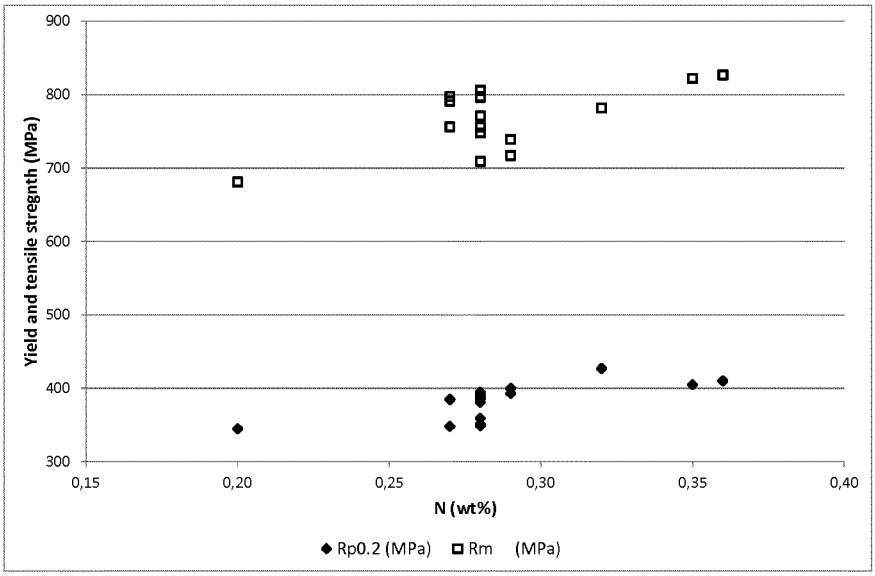
FIG. 1A shows the yield and tensile strength as a function of the nitrogen content for the compositions of table 1.

Hence, the present disclosure provides an austenitic stainless alloy having the following composition:

C less than 0.03;
Si less than 1.0;
Mn less than or equal to 1.2;
Cr 26.0 to 30.0;
Ni 29.0 to 37.0;
Mo or (Mo+W/2) 6.1 to 7.1;
N 0.25 to 0.36;
P less than or equal to 0.04
S less than or equal to 0.03;
Cu less than or equal to 0.4;
balance Fe and unavoidable impurities.

The austenitic stainless alloy as defined hereinabove or hereinafter will have high corrosion resistance and good structure stability. By good structure stability is meant that there will almost be no precipitates of intermetallic phases formed in the austenitic stainless alloy during the manufacturing process. Furthermore, the austenitic stainless alloy as defined hereinabove or hereinafter will have a combination of high strength, such as yield strength and tensile strength, and good ductility very good corrosion properties and good weldability.

This austenitic stainless alloy as defined hereinabove and hereinafter is be used for manufacturing an object, such as a tube, a bar, a pipe, a wire, a strip, a plate and/or a sheet. These products are aimed to be used in applications requiring high corrosion resistance and good mechanical properties, such as in the oil and gas industry, petrochemical industry, chemical industry, pharmaceutical industry and/or environmental engineering. The method used for manufacturing these products is conventional manufacturing processes, such as but not limited to melting, AOD converter, casting, forging, extrusion, drawing, hot rolling and cold rolling.

Hereinafter, the alloying elements of the austenitic stainless alloy as defined hereinabove or hereinafter are discussed, wherein wt % is weight %:

Carbon (C): Less than or Equal to 0.03 wt %

C is an impurity contained in the austenitic stainless alloy. When the content of C exceeds 0.03 wt %, the corrosion resistance is reduced due to the precipitation of chromium carbide in the grain boundaries. Thus, the content of C is less than or equal to 0.03 wt %, such as less than or equal to 0.02 wt %.

Silicon (Si): Less than or Equal to 1.0 wt %

Si is an element which may be added for deoxidization. However, Si will promote the precipitation of the intermetallic phases, such as the sigma phase, therefore Si is contained in a content of 1.0 wt % or less, such as 0.5 wt % or less. According to one embodiment, Si is more than 0.01 wt %. According to one embodiment, Si is less than 0.3 wt %. According to yet an embodiment, Si is of from 0.1 to 0.3 wt %.

Manganese (Mn): Less than or Equal to 1.2 wt %

Mn is used in most stainless alloys because Mn will form MnS, which will improve the hot ductility. Mn is also considered to be beneficial for increasing strength in most austenitic stainless alloys when added in high amounts (such as around 4 wt %). However, it has, for the austenitic stainless alloy as defined hereinabove or hereinafter, surprisingly been found that a content of Mn above 1.5 wt %, will reduce the strength of the austenitic stainless alloy, therefore, the content of Mn is less than or equal to 1.2 wt %, such as less than or equal to 1.1 wt %, such as less than or equal to 1.0 wt %. According to one embodiment, the content of Mn is of from 0.01 to 1.1 wt %. According to another embodiment, Mn is from 0.6 to 1.1 wt %.

Nickel (Ni): 29 wt % to 37 wt %

Nickel is together with Cr and Mo beneficial for improving the resistance to stress corrosion cracking in the austenitic stainless alloys. Additionally, nickel is also an austenite stabilizing element and will also reduce the precipitation of intermetallic phases in the grain boundaries of the austenitic stainless steel, especially when it is exposed to a temperature interval of 600-1100° C. The grain boundary precipitates may affect the corrosion resistance negatively. The nickel content is therefore at least or equal to 29 wt %, such as at least 31 wt %, such as at least 34 wt %. However, increased nickel content will decrease the solubility of N. Therefore, the maximum content of Ni is less than or equal to 37 wt %, such as less than or equal to 36 wt %. According to one embodiment, the Ni content is of from 34 to 36 wt %

Chromium (Cr): 26 to 30 wt %

Cr is the most important element in stainless alloys as Cr is essential for creating the passive film, protecting the stainless alloy from corroding. Also, the addition of Cr will increase the solubility of N. When the content of Cr is less than 26 wt %, the pitting corrosion resistance for the present austenitic stainless alloy will not be sufficient. Additionally when the content of Cr is more than 30 wt %, secondary phases, such as nitrides and sigma phase will be formed, which will adversely affect the corrosion resistance. Accordingly, the content of Cr is therefore of from 26 to 30 wt %, such as more than 26 wt %, such as of from 26 to 29 wt %, such as of from 26 to 28 wt %, such as of more than 26 to 29 wt %, such as of more than 26 to 28 wt %.

Molybdenum (Mo):6.1 to 7.1 wt % Mo is effective in stabilizing the passive film formed on the surface of the austenitic stainless alloy and is also effective in improving the pitting resistance. When the content of Mo is less than 6.1 wt %, the corrosion resistance against pitting will not be high enough for the austenitic stainless alloy as defined hereinabove or hereinafter. However, a too high content of Mo will promote the precipitation of intermetallic phases, such as sigma phase and also deteriorate the hot workability. Accordingly, the content of Mo is of from 6.1 to 7.1 wt %, such as of from 6.3 to 6.8 wt %.

(Mo+W/2): 6.1 to 7.1 wt %

If present, W is half the effect of Mo (in weight %), which is proven by the PRE-equation $$Cr+3.3(Mo+0.5\ W)+16N.$$

Mo and W are effective in stabilizing the passive film formed on the surface of the austenitic stainless alloy and is also effective in improving the pitting resistance. When the content of (Mo+W/2) is less than 6.1 wt %, the corrosion resistance against pitting will not be high enough for the austenitic stainless alloy as defined hereinabove or hereinafter. However, a too high content of Mo and W/2 will promote the precipitation of intermetallic phases, such as sigma phase and also deteriorate the hot workability. If present, the content of W in the present alloy is between 0.001 to 3.0 wt %, such as of from 0.1 to 3.0 wt %. It is to be understood, that the content of Mo in the present alloy is then in the range fulfilling the condition (Mo+W/2) is 6.1 to 7.1. According to one embodiment, (Mo+W/2) is 6.3 to 6.8 wt %.

Nitrogen (N): 0.25 to 0.36 wt %

N is an effective element for increasing the strength in austenitic stainless alloy by using solution hardening. N is also beneficial for the structure stability. Furthermore, N will improve the deformation hardening during cold working. When the content of N is less than 0.25 wt %, the neither the strength or nor the ductility will be high enough. If the content of N is more than 0.36 wt %, the flow stress will be too high for obtaining efficient hot workability. Thus, in the present disclosure, the inventors have surprisingly found that a austenitic stainless alloy having a combination of both improved ductility and yield strength will be obtained if the content of N is of from 0.25 to 0.36 wt %, such as of from 0.26 wt % to 0.33 wt %, such as 0.26 to 0.30.

Phosphorus (P): Less than or Equal to 0.04 wt %

P is considered to be an impurity and it is well known that P will affect the hot workability negatively. Accordingly, the content of P is set at less than or equal to 0.04 wt % or less such as less than or equal to 0.03 wt %.

Sulphur (S): Less than or Equal to 0.03 wt %

S is considered to be an impurity as it will deteriorate the hot workability. Accordingly, the allowable content of S is less than or equal to 0.03 wt %, such as less than or equal to 0.02 wt %.

Copper (Cu): Less than or Equal to 0.4 wt %

Cu is an optional element and is considered as an impurity. The present stainless alloy comprises Cu due to the raw material used as the manufacturing material. The content of Cu should be as low as possible, and therefore the level of Cu for the present alloy is less than or equal to 0.4 wt % as above this level the mechanical properties will be negatively affected. According to one embodiment, Cu may be present in an amount of from 0.001 to 0.4 wt %.

The austenitic stainless alloy as defined hereinabove or herein after may optionally comprise one or more of the following elements selected from the group of Al, V, Nb, Ti, O, Zr, Hf, Ta, Mg, Pb, Co, Bi, Ca, La, Ce, Y and B. These elements may be added during the manufacturing process in order to enhance e.g. deoxidation, corrosion resistance, hot ductility and/or machinability. However, as known in the art, the addition of these elements has to be limited depending on which element is present. Thus, if added the total content of these elements is less than or equal to 1.0 wt %.

The term "impurities" as referred to herein is intended to mean substances that will contaminate the austenitic stainless alloy when it is industrially produced, due to the raw materials such as ores and scraps, and due to various other factors in the production process, and are allowed to contaminate within the ranges not adversely affecting the austenitic stainless alloy as defined hereinabove or hereinafter.

According to one embodiment, the alloy as defined hereinabove or hereinafter consist of the following:

C less than 0.03;
Si less than 1.0;
Mn less than or equal to 1.2;
Cr 26.0 to 30.0;
Ni 29.0 to 37.0;
Mo or (Mo+W/2) 6.1 to 7.1;
N 0.25 to 0.36;
P less than or equal to 0.04
S less than or equal to 0.03;
Cu less than or equal to 0.4;

and optionally one or more elements of the group of Al, V, Nb, Ti, O, Zr, Hf, Ta, Mg, Pb, Co, Bi, Ca, La, Ce, Y and B less than or equal to 1.0 wt;

balance Fe and unavoidable impurities.

Further, when the expression "less than" is used, it is to be understood that unless stated otherwise, the lower limit is 0 wt %.

The present disclosure is further illustrated by the following non-limiting examples:

EXAMPLES

Example 1

17 different alloys were melted in a high frequency induction furnace as 270 kg heats and then cast to ingots using a 9" mould. The chemical compositions of the heats are shown in Table 1.

After casting, the moulds were removed and the ingots were quenched in water. A sample for chemical analysis was taken from each ingot. After casting of heat no 605813-605821 and mould removal, the ingots were quench annealed at 1170° C. for 1 h. The chemical analyses were performed by using X-Ray Fluorescence Spectrometry and Spark Atomic Emission Spectrometry and combustion technique.

The obtained ingots were forged to 150×70 mm billets in a 4 metric ton hammer Prior to forging, the ingots were heated to 1220° C.-1250° C. with a holding time of 3 hours. The obtained forged billets were then machined to 150×50 mm billets, which were hot rolled to 10 mm in a Robertson rolling mill. Before the hot rolling, the billets were heated to 1200° C.-1220° C. with a holding time of 2 hours.

The austenitic stainless alloy was heat treated at 1200-1250° C. with varying holding times followed by water quenching.

TABLE 1

Chemical compositions of the heats. The heats have an austenite grain size of 90-110 μm as smaller and larger sizes will affect the strength of the heat. Heats marked with "*" is within the scope of the present disclosure.

| | Chemical analyse in wt % | | | | | | | | | | |
|---|---|---|---|---|---|---|---|---|---|---|---|
| Heat | C | Si | Mn | P | S | Cr | Ni | Mo | N | Cu | W |
| 605813 | 0.007 | 0.21 | 2.90 | 0.005 | <0.0005 | 28.27 | 30.04 | 6.46 | 0.20 | 0.20 | <0.01 |
| 605817* | 0.008 | 0.25 | 1.02 | 0.004 | <0.0005 | 28.64 | 29.93 | 6.57 | 0.32 | 0.20 | <0.01 |
| 605818 | 0.007 | 0.22 | 2.96 | 0.004 | <0.0005 | 27.44 | 30.15 | 6.54 | 0.28 | 0.19 | <0.01 |
| 605820 | 0.007 | 0.21 | 2.94 | 0.005 | <0.0005 | 30.17 | 35.05 | 6.54 | 0.29 | 0.21 | <0.01 |
| 605821* | 0.008 | 0.22 | 1.00 | 0.006 | 0.0010 | 29.45 | 30.29 | 6.52 | 0.29 | 0.20 | n.d. |
| 605872* | 0.008 | 0.22 | 1.03 | 0.007 | <0.0005 | 26.81 | 32.66 | 6.24 | 0.28 | 0.19 | <0.01 |
| 605873* | 0.008 | 0.22 | 1.00 | 0.006 | <0.001 | 26.74 | 34.83 | 6.15 | 0.28 | 0.20 | <0.01 |
| 605874* | 0.007 | 0.20 | 1.00 | 0.007 | <0.0005 | 26.66 | 32.47 | 6.92 | 0.28 | 0.19 | <0.01 |
| 605875* | 0.007 | 0.20 | 0.99 | 0.006 | <0.0005 | 26.72 | 34.75 | 6.98 | 0.28 | 0.19 | <0.01 |
| 605881 | 0.006 | 0.22 | 1.01 | 0.006 | <0.0005 | 25.98 | 29.95 | 7.04 | 0.27 | 0.22 | <0.01 |
| 605882 | 0.007 | 0.20 | 0.99 | 0.006 | <0.0005 | 25.76 | 34.93 | 6.97 | 0.27 | 0.19 | <0.01 |
| 605883* | 0.008 | 0.21 | 0.98 | 0.007 | <0.0005 | 26.84 | 30.21 | 6.52 | 0.35 | 0.19 | <0.01 |
| 605884* | 0.009 | 0.21 | 1.00 | 0.006 | <0.0005 | 26.83 | 34.92 | 6.48 | 0.36 | 0.19 | <0.01 |
| 605894 | 0.009 | 0.19 | 0.98 | 0.020 | <0.0005 | 25.47 | 34.66 | 6.47 | 0.27 | 0.18 | <0.01 |
| 605895 | 0.009 | 0.23 | 1.03 | 0.007 | <0.0005 | 25.62 | 34.80 | 6.52 | 0.28 | 1.93 | <0.01 |
| 605896 | 0.009 | 0.20 | 1.02 | 0.009 | <0.0005 | 25.82 | 35.02 | 3.59 | 0.28 | 0.29 | 5.7 |
| 605897* | 0.013 | 0.30 | 1.00 | 0.008 | <0.0005 | 26.03 | 34.81 | 4.94 | 0.28 | 0.20 | 2.92 |

The tensile properties of the heats were determined according to SS-EN ISO 6892-1:2009 at room temperature. Tensile testing was performed on the hot rolled and quench annealed plates 10 mm in thickness by using turned specimens according to specimen type 5C50 in SS 112113 (1986) wherein the diameter of the specimen is 5 mm Three samples were used for each heat.

TABLE 2

Result of tensile testing at RT.

| | Mechanical properties | | |
|---|---|---|---|
| Heat | $Rp_{0.2}$ (MPa) | $R_m$ (MPa) | A (%) |
| 605813 | 345 | 681 | 55.6 |
| 605817* | 427 | 782 | 63.8 |
| 605818 | 381 | 709 | 62.3 |
| 605820 | 393 | 717 | 66.5 |
| 605821* | 400 | 739 | 61.8 |
| 605872* | 386 | 797 | 56.3 |
| 605873* | 392 | 797 | 56.9 |
| 605874* | 389 | 797 | 57.1 |
| 605875* | 395 | 806 | 57.4 |
| 605881 | 385 | 791 | 56.3 |
| 605882 | 385 | 798 | 58.0 |
| 605883* | 405 | 822 | 60.0 |
| 605884* | 410 | 827 | 60.0 |
| 605894 | 348 | 756 | 64.9 |
| 605895 | 349 | 748 | 66.0 |
| 605896 | 359 | 771 | 66.3 |
| 605897* | 351 | 756 | 66.8 |

Figure 1B:
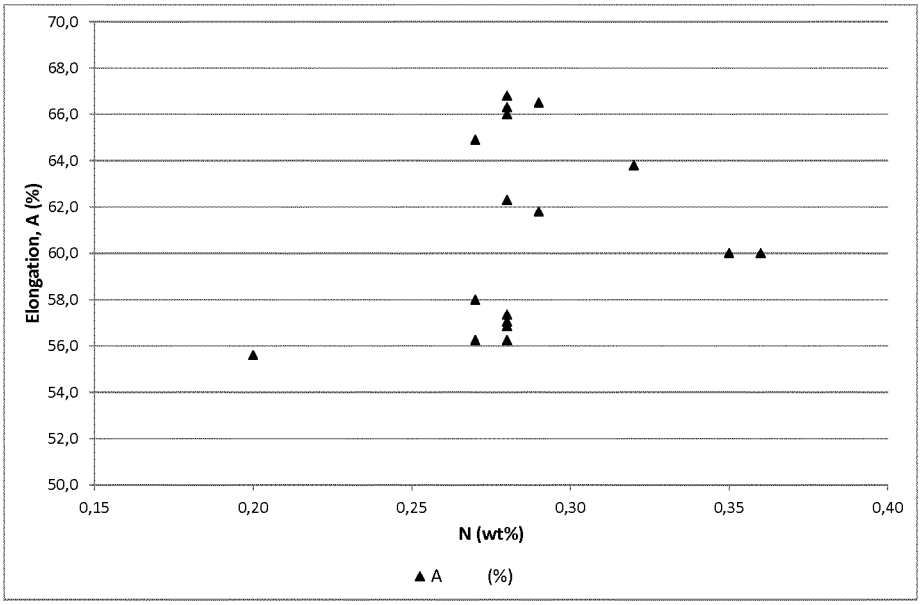
FIG. 1B shows the elongation as a function of the nitrogen content for the compositions of table 1.

In FIGS. 1A and 1B, the variables yield strength ($Rp_{0.2}$), tensile strength ($R_m$) and elongation (A) are plotted against the nitrogen content of the experimental heats in hot rolled and heat treated condition. As can be seen from FIG. 1B, the elongation (A) is surprisingly increased with increased nitrogen content, usually when the nitrogen content is as high as in the present disclosure, the elongation is reduced. Also, FIG. 1A shows that the heat of the present disclosure will have high yield strength ($Rp_{0.2}$) and high tensile strength ($R_m$).

Figure 2:
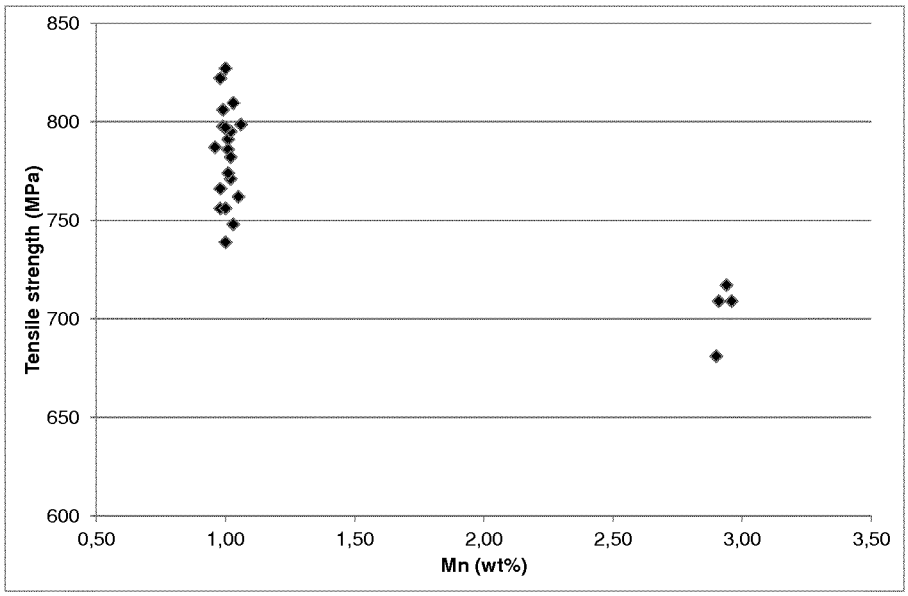
FIG. 2 discloses the tensile strength of the austenitic stainless alloys of table 1 as a function of the Mn content for the compositions of table 1.

In FIG. 2, the tensile strength is plotted against the Mn content. As can be seen from the figure, the content of Mn will affect the tensile strength, all heats having a content of Mn within the range of the present disclosure has a tensile strength of around 739 MPa or above whereas the heats having a Mn content above 2.90, have a tensile strength of around 717 MPa or lower. This is very surprising because usually Mn is considered to be beneficial for increasing the strength in austenitic stainless alloys when added in high amounts (such as around 4 wt %).

Example 2 Comparison with Other Alloys

TABLE 3

The tensile properties of different alloys

| Alloy (Tradename) | Major element in the composition | $R_{p0.2}$ (MPa) | $R_m$ (MPa) | A (%) |
|---|---|---|---|---|
| Nickelbased | | | | |
| Hastelloy ® C-276 | Ni 57.00<br>Co 2.50<br>Cr 15.50<br>Mo 16.00<br>W 4.00<br>Fe 5.50 | 365 | 786 | 59 |
| Hastelloy ® C-22 | Ni: 56<br>Cr: 22<br>Mo: 13<br>Fe 3<br>Co: max. 2.5<br>W: 3 | 372 | 786 | 62 |
| Austenitic alloys | | | | |
| Austenitic alloy type 317L | Cr 18.0-20.0<br>Ni 11.0-15.0<br>Mo 3.0-4.0 | 300 | 610 | 50 |
| Austenitic alloy type 904L | Ni 23.0-28.0<br>Cr 19.0-23.0<br>Mo 4.0-5.0 | 260 | 600 | 50 |

As can be seen from by comparing the data of table 2 and table 3, the alloys of the present disclosure have surprisingly been found to have a strength which is corresponds to the strength of a nickel-based alloy and also which is higher than a conventional austenitic stainless steel.

Example 3 Pitting Corrosion Test

The influence of Cr in the pitting corrosion was studied. The pitting corrosion is one of the most damaging forms of corrosion and it is essential to limit this corrosion especially in oil-and-gas applications, chemical and petrochemical industry, pharmaceutical industry and environmental engineering.

For the pitting corrosion testing, the samples of heat no. 605875, 605881 and 605882 which had been hot rolled and annealed (see example 1) were cold rolled and then annealed at 1200° C. with a holding time of 10 minutes followed by water quenching.

The pitting resistance was studied by determining the critical pitting temperatures (CPT) for each heat. The test method used is described in ASTM G150 but in this particular testing the electrolyte was changed to 3M $MgCl_2$ which allows for testing at higher temperatures compared to the original electrolyte 1M NaCl. The samples were ground to P600 paper before testing.

In Table 4 the influence of the chromium content on the pitting resistance (CPT) is shown.

TABLE 4

Influence of chromium on pitting resistance.

| Heat | Cr | CPT (° C.) |
|---|---|---|
| no. 605875 | 26.72 | 112.6 |
| no. 605881 | 25.98 | 108.0 |
| no. 605882 | 25.76 | 105.6 |

As can been seen from this table, the Cr content has a great influence on the pitting corrosion. A corrosion pitting temperature above 108° C. is desirable for having excellent pitting corrosion resistance.

The invention claimed is:

1. An austenitic stainless alloy consisting of in weight %:
C less than 0.03;
Si more than 0.1 to less than 1.0;
Mn 0.6 to 1.1;
Cr 26.0 to 30.0;
Ni 34.0 to 37.0;
Mo 6.3 to 7.1;
N 0.25 to 0.36;
P less than or equal to 0.04;
S less than or equal to 0.03;
Cu 0.001 to 0.4;
one or more elements of the group of Al, V, Nb, Ti, O, Zr, Hf, Ta, Mg, Pb, Co, Bi, Ca, La, Ce, Y and B in a total content of less than or equal to 1.0; and
a balance of Fe and unavoidable impurities,
wherein the austenitic stainless alloy has a yield strength ($Rp_{0\ 2}$) of 351 MPa to 427 MPa, and
wherein the austenitic stainless alloy has a critical pitting temperature of greater than 108° C., conducted per ASTM G150 with 3M $MgCl_2$ and ground sample.

2. The austenitic stainless alloy according to claim 1, wherein the content of Si is less than 0.5 wt %.

3. The austenitic stainless alloy according to claim 1, wherein the content of Si is from 0.1 to 0.3 wt %.

4. The austenitic stainless alloy according to claim 1, wherein the content of Cr is from 26 to 29 wt %.

5. The austenitic stainless alloy according to claim 1, wherein the content of Cr is more than 26 wt %.

6. The austenitic stainless alloy according to claim 1, wherein the content of Mo is from 6.3 to 6.8 wt %.

7. An object comprising the austenitic stainless alloy according to claim 1.

8. The object according to claim 7, wherein said object is a tube, a pipe, a bar, a wire, a plate, a sheet and/or a strip.

9. The austenitic stainless alloy according to claim 1, wherein the content of Ni is from 34 to 36 wt %.

10. The austenitic stainless alloy according to claim 1, wherein the content of Cr is from 26 to 28 wt %.

11. The austenitic stainless alloy according to claim 1, wherein the austenitic stainless alloy has a critical pitting temperature of 108° C. to 112.6° C.

12. The austenitic stainless alloy according to claim 1, wherein the austenitic stainless alloy has a tensile strength ($R_m$) of 739 MPa to 827 MPa.

13. The austenitic stainless alloy according to claim 1, wherein the austenitic stainless alloy has an elongation (A) of 56.3% to 66.8%.

14. The austenitic stainless alloy according to claim 1, wherein W is 0.1 to 3.0 and in combination with Mo such that (Mo+W/2) is 6.3 to 6.8.

15. The austenitic stainless alloy according to claim 1, wherein W is 2.9 to 3.0 and in combination with Mo such that (Mo+W/2) is 6.3 to 6.8.

16. An austenitic stainless alloy consisting of in weight %:

C less than 0.03;

Si more than 0.1 to less than 1.0;

Mn 0.01 to 1.1;

Cr 26.0 to 30.0;

Ni 34.0 to 37.0;

W 2.9 to 3.0 and in combination with Mo such that (Mo+W/2) is 6.3 to 7.1;

N 0.25 to 0.36;

P less than or equal to 0.04;

S less than or equal to 0.03;

Cu 0.001 to 0.4;

one or more elements of the group of Al, V, Nb, Ti, O, Zr, Hf, Ta, Mg, Pb, Co, Bi, Ca, La, Ce, Y and B in a total content of less than or equal to 1.0; and a balance of Fe and unavoidable impurities.

17. The austenitic stainless alloy according to claim 16, wherein the austenitic stainless alloy has a yield strength ($Rp_{0\ 2}$) of 351 MPa to 427 MPa.

18. The austenitic stainless alloy according to claim 16, wherein the austenitic stainless alloy has a critical pitting temperature of 108° C. to 112.6° C., conducted per ASTM G150 with 3M $MgCl_2$ and ground sample.

* * * * *